US007195708B2

(12) United States Patent
Mullner, Jr.

(10) Patent No.: US 7,195,708 B2
(45) Date of Patent: Mar. 27, 2007

(54) SKIMMER GUARD FOR A SWIMMING POOL

(76) Inventor: Nandor Mullner, Jr., 212 Edgar Ave., Aston, PA (US) 19014

( * ) Notice: Subject to any disclaimer, the term of this patent is extended or adjusted under 35 U.S.C. 154(b) by 11 days.

(21) Appl. No.: 11/180,355

(22) Filed: Jul. 13, 2005

(65) Prior Publication Data

US 2007/0012607 A1 Jan. 18, 2007

(51) Int. Cl.
*E04H 4/12* (2006.01)

(52) U.S. Cl. ..... 210/167.19; 210/232; 210/416.2; 4/496; 4/507

(58) Field of Classification Search ..... 210/169, 210/232, 416.1, 416.2, 167.01, 167.1, 167.19; 4/496, 507, 490
See application file for complete search history.

(56) References Cited

U.S. PATENT DOCUMENTS

| | | | | |
|---|---|---|---|---|
| 1,654,246 | A | 12/1927 | Egan | |
| 4,140,634 | A | 2/1979 | Harry | |
| 4,594,157 | A | 6/1986 | McGowan | |
| 5,285,538 | A | 2/1994 | Hodak | |
| 5,833,845 | A | 11/1998 | Anderson | |
| 5,935,450 | A | 8/1999 | Benedict | |
| D429,858 | S | 8/2000 | Smith | |
| 6,214,217 | B1 | 4/2001 | Sliger | |
| D444,628 | S | 7/2001 | Schwarz | |
| 6,770,193 | B2 * | 8/2004 | Foley | 210/169 |
| 6,817,041 | B1 * | 11/2004 | Evans et al. | 4/496 |
| 7,011,747 | B2 * | 3/2006 | Hodak | 210/169 |
| 7,052,602 | B2 * | 5/2006 | Boggs et al. | 210/169 |
| 2004/0074831 | A1 * | 4/2004 | Mhoon et al. | 210/169 |
| 2005/0087482 | A1 * | 4/2005 | Hodak | 210/169 |
| 2005/0199538 | A1 * | 9/2005 | Knapp et al. | 210/169 |
| 2005/0211614 | A1 * | 9/2005 | Boggs et al. | 210/169 |

FOREIGN PATENT DOCUMENTS

| | | | |
|---|---|---|---|
| FR | 2736344 | * | 1/1997 |

* cited by examiner

*Primary Examiner*—Fred G. Prince
(74) *Attorney, Agent, or Firm*—William H. Eilberg

(57) ABSTRACT

A skimmer for a pool includes a skimmer guard that is installed by friction only, and without the use of separate fasteners. In one embodiment, the skimmer guard includes a perforated portion surrounded by a peripheral lip, the lip being shaped for engagement with a flange formed on a frame mounted to a skimmer opening. The skimmer guard is inserted onto the flange, and thus prevents debris from entering the skimmer. In another embodiment, the skimmer guard includes a perforated face plate and a plug, the plug being sized for frictional engagement with a skimmer opening. In all cases, the skimmer guard is inserted without the use of separate fasteners, and without the use of tools. The skimmer guard can be removed and replaced with a non-perforated version, at the end of the swimming season.

13 Claims, 5 Drawing Sheets

SKIMMER GUARD FOR A SWIMMING POOL

BACKGROUND OF THE INVENTION

The present invention relates to the field of treatment of water for swimming pools and the like, and provides a convenient device for preventing debris from interfering with such treatment.

A swimming pool is commonly equipped with a skimmer, which is a device for drawing in water from the pool, filtering the water, and returning the filtered water to the pool. Skimmers can be provided both for in-ground pools and above-ground pools, and are usually located immediately outside the periphery of the pool. The skimmer receives water from an opening in the side wall of the pool.

A major problem in the operation of a skimmer is the unwanted entry of debris from the pool. At any given time, there may be various items floating in the pool, such as leaves, children's toys, or other objects. These items inevitably float towards the skimmer opening, especially in view of the negative pressure created by the flow of water into the skimmer. Thus, the debris will likely enter the skimmer, potentially causing serious clogs, and preventing the skimmer from operating properly. A severe clog may cause the circulation pump of the skimmer to burn out.

A skimmer typically has a flap, disposed in an opening of the pool wall, for regulating the flow of water into the skimmer. Entry of debris into the opening may interfere with the operation of the flap. The skimmer may also include a device for automatically dispensing chlorine into the pool. Debris from the pool may interfere with the dispensing of chlorine.

Another problem with typical skimmers is caused by children. A curious child can easily insert his or her hand into the skimmer opening, interfering with the above-described flap and/or chlorine dispenser. It is therefore necessary to provide a device which prevents such occurrences.

Various efforts have been made to solve the above problems. The typical solution is to cover the skimmer opening with a screen or strainer, as is shown, for example, in U.S. Pat. Nos. 4,140,634 and 6,214,217. While such devices, and others, do prevent much debris from entering the skimmer, and do prevent access to components within the skimmer opening, the devices are inconvenient to use, as they are attached to the skimmer opening by separate fastening devices, such as screws or nails. Thus, to install or remove such devices, the user must have a tool available, such as a screwdriver.

U.S. Pat. No. 5,285,538 discloses a cover that does not need to be screwed in, but the patented cover serves to seal off the skimmer during the season in which the pool is not in use. The latter patent does not show a device which will protect a skimmer from debris when the pool is in use.

The present invention provides a skimmer guard which combines the advantages of the references mentioned above, while avoiding their disadvantages. The invention includes a device which effectively protects a skimmer from debris, and which does not require any tool to install or remove.

SUMMARY OF THE INVENTION

The present invention comprises a skimmer guard which covers an opening in a pool wall, and wherein the skimmer guard is installed by friction only, and without separate fasteners. The skimmer guard defines a plurality of holes which allow liquid to flow into the skimmer, while preventing the entry of debris.

In one preferred embodiment, the skimmer opening is bounded by a frame, the frame having a peripheral flange. The skimmer guard includes a peripheral lip which is shaped to engage the flange. The skimmer guard can therefore be snapped onto the frame, without the use of screws, nails, or other separate fasteners, and remains in engagement with the frame by friction only.

In another preferred embodiment, the skimmer guard includes a perforated face plate and a plug, the plug being sized to fit snugly within the skimmer opening. As in the first embodiment, the skimmer guard is mounted so that the face plate substantially spans the opening, thus preventing most debris from entering the skimmer. The skimmer guard remains in place due to the friction between the plug and the walls of the opening.

The invention also includes the method of protecting a pool skimmer, the method comprising engaging a skimmer guard with an opening in the pool wall, the engagement being performed by friction only and without separate fasteners. The engagement of the skimmer guard can be accomplished by engaging a lip with a flange, as described above, or by inserting a plug portion of the skimmer guard into the opening.

The invention also includes the method wherein a perforated skimmer guard is installed, and wherein the perforated skimmer guard is removed and replaced with a similar skimmer guard which is constructed without holes. Typically, the perforated skimmer guard is installed at the beginning of the swimming season, and the non-perforated skimmer guard is installed at the end of such season.

The invention therefore has the primary object of providing a skimmer guard for a swimming pool.

The invention has the further object of providing a skimmer guard which can be attached without the use of separate fasteners such as screws, nails, or the like.

The invention has the further object of providing a skimmer guard which can be installed without the use of tools.

The invention has the further object of prolonging the useful life of a pool skimmer, by preventing entry of debris from the pool.

The invention has the further object of providing a method of attachment and removal of a skimmer guard.

The invention has the further object of providing a convenient method of changing skimmer guards at the beginning and end of a season of swimming pool use.

The invention has the further object of providing a convenient and economical means for preventing debris from entering, and potentially clogging, a pool skimmer.

The invention has the further object of preventing harm to components located within a skimmer guard due to contact by children.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
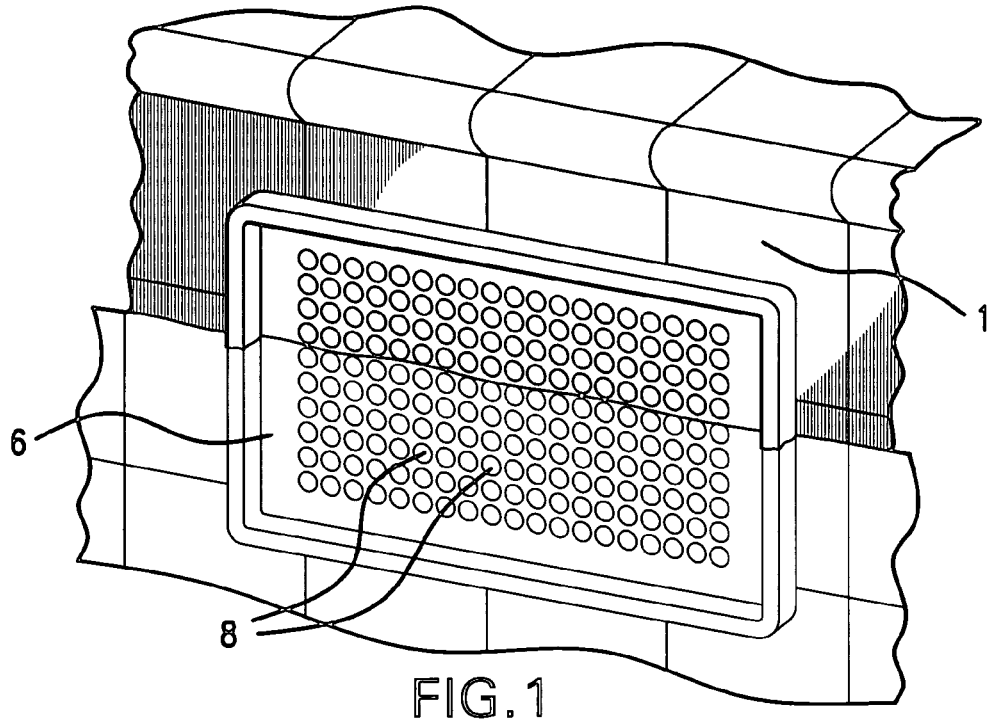
FIG. 1 provides a fragmentary perspective view, showing a skimmer opening of a swimming pool, the opening being equipped with a skimmer guard made according to the present invention.
Figure 3:
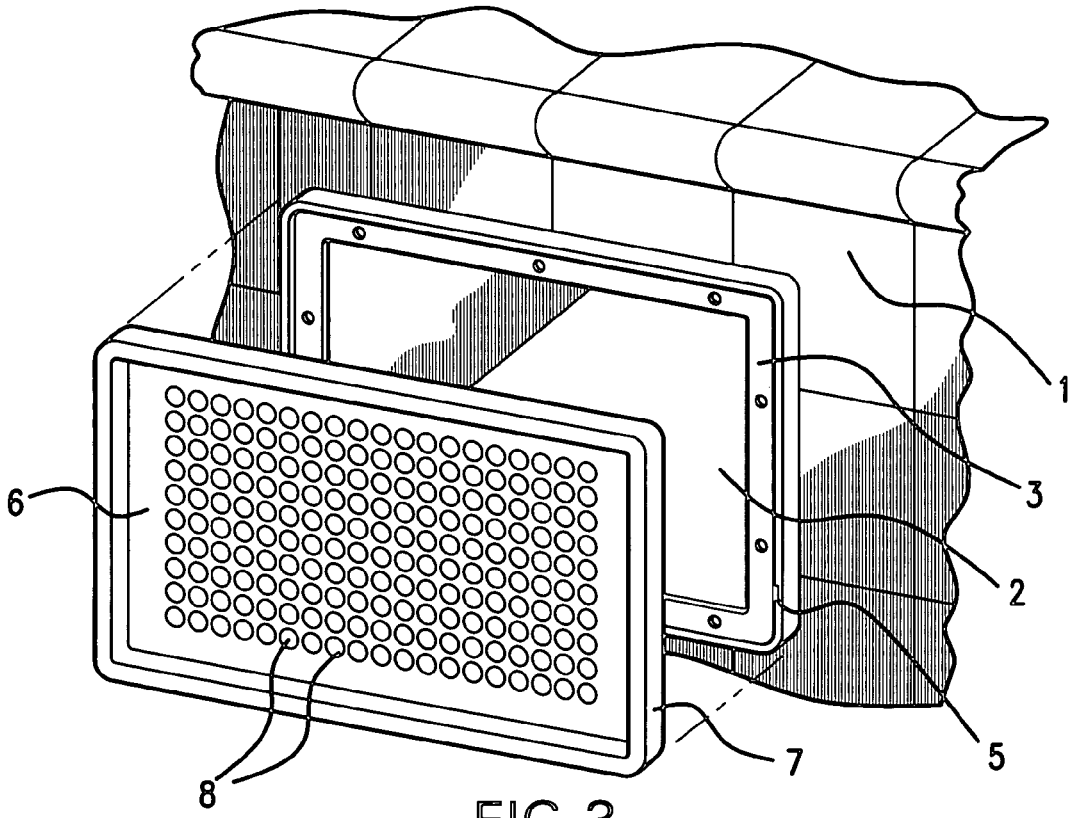
FIG. 3 provides a fragmentary and exploded perspective view, showing the skimmer guard of the present invention detached from the skimmer frame.
Figure 2:
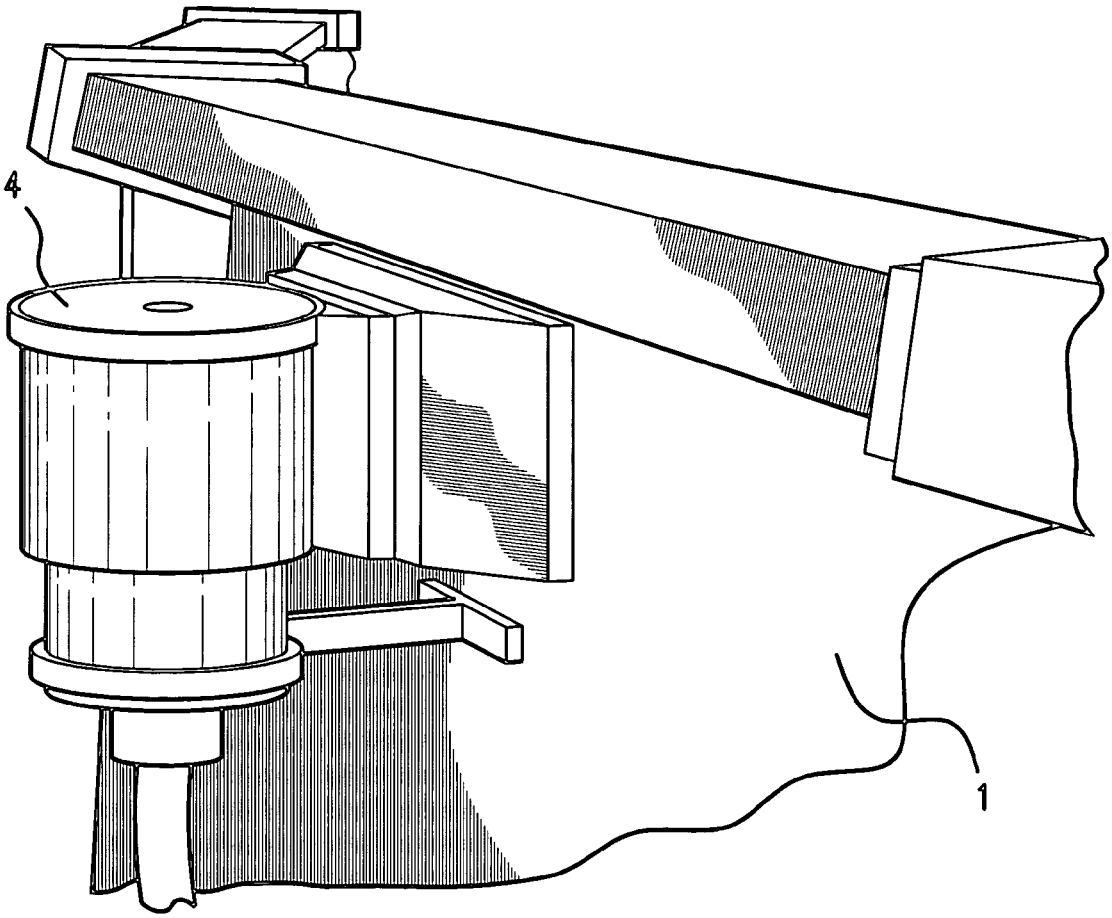
FIG. 2 provides a fragmentary perspective view of an exterior portion of a swimming pool, showing the skimmer used with the present invention.

The basic operation of the present invention is illustrated in FIGS. 1–3. A swimming pool, or other pool, includes a wall 1. The wall includes a skimmer opening 2 which allows water from the pool to enter skimmer 4 which is located outside the periphery of the pool wall. In the illustration of FIG. 2, the pool is an above-ground structure, and the skimmer is plainly visible. The invention could also be practiced with an in-ground pool, in which case the skimmer may be located below ground level.

The skimmer opening 2 is bounded by frame 3, which is affixed to the wall, such as by screws, the frame being intended to comprise a permanent fixture of the pool. The frame includes flange 5, positioned along the periphery of the frame, as will be described in more detail later.

A skimmer guard 6 includes a peripheral lip 7, the lip being configured to engage the flange 5 by friction only. A plurality of holes 8 are formed in the skimmer guard.

FIG. 3 shows the skimmer guard while it is in a detached position, the figure also showing the uncovered skimmer opening 2. The skimmer guard is attached to the frame 3 by frictionally engaging the lip 7 with the flange 5. The skimmer guard is therefore attached to the frame in a manner analogous to the attachment of a lid of a conventional plastic food container. FIG. 1 shows the skimmer guard in place, installed on the frame, and with water in the pool. The holes 8, which remain unblocked when the skimmer guard is installed, allow water to flow into the skimmer opening, but they block most debris. Thus, the skimmer guard acts as a strainer, preventing debris from entering the skimmer. The size of the debris capable of entering the skimmer is determined by the size of the holes in the skimmer guard.

The skimmer guard also inherently protects components that may be located within the skimmer opening. Such components may include a flap which regulates the flow of liquid into the skimmer, and may also include a device for dispensing chlorine into the pool. The skimmer guard prevents debris from interfering with these components, and also prevents children from reaching into the opening and damaging such components. It also prevents harm to children that may result from such contact.

Figure 4:
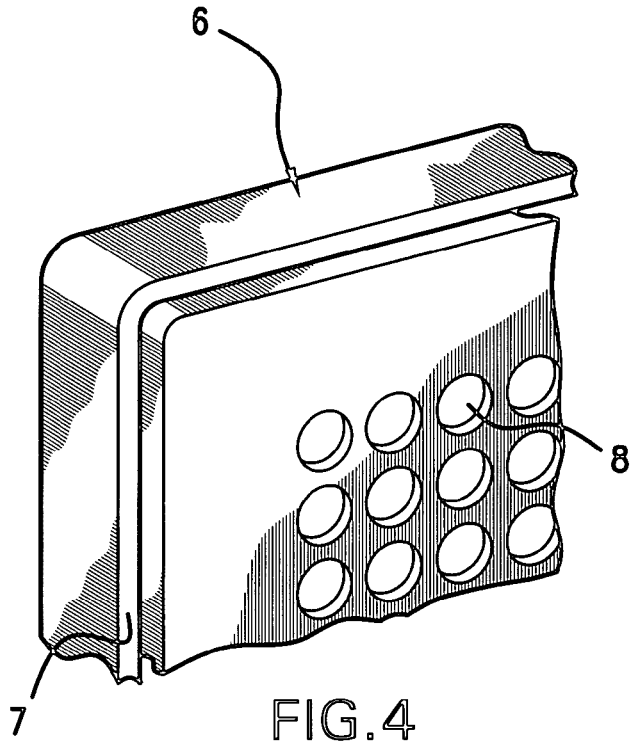
FIG. 4 provides a fragmentary perspective view of a portion of the skimmer guard of the present invention.
Figure 5:
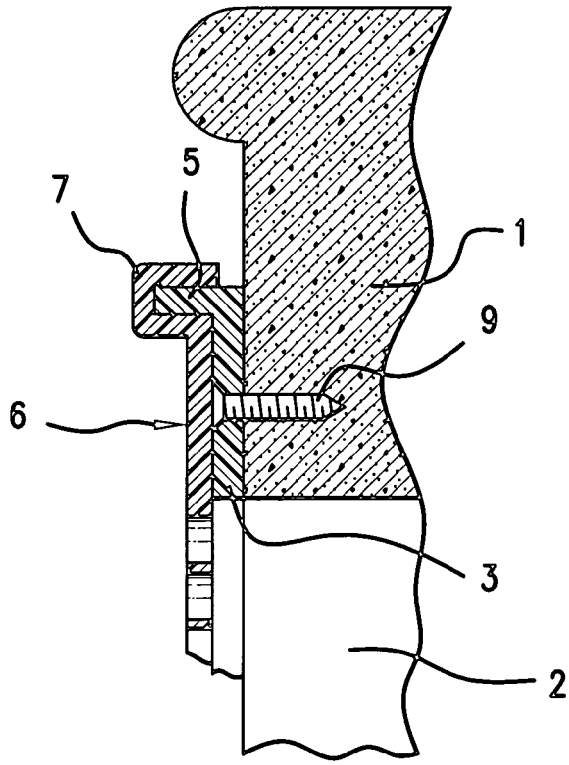
FIG. 5 provides a fragmentary cross-sectional view, showing the skimmer guard of the present invention after it has been installed onto the skimmer frame.

FIGS. 4 and 5 provide more details of the construction of the device of the present invention. FIG. 4 shows a fragment of the skimmer guard 6, with a detail of lip 7 and holes 8. FIG. 5 shows a cross-section of pool wall 1. Frame 3, which surrounds skimmer opening 2, is affixed to the pool wall by screw 9. The frame defines flange 5. The lip 7 of skimmer guard 6 is frictionally engaged with flange 5, as shown. FIG. 5 emphasizes the fact that the engagement of skimmer guard 6 with frame 3 is by friction only, and does not use screws, nails, or other extraneous means of attachment.

Figure 6:
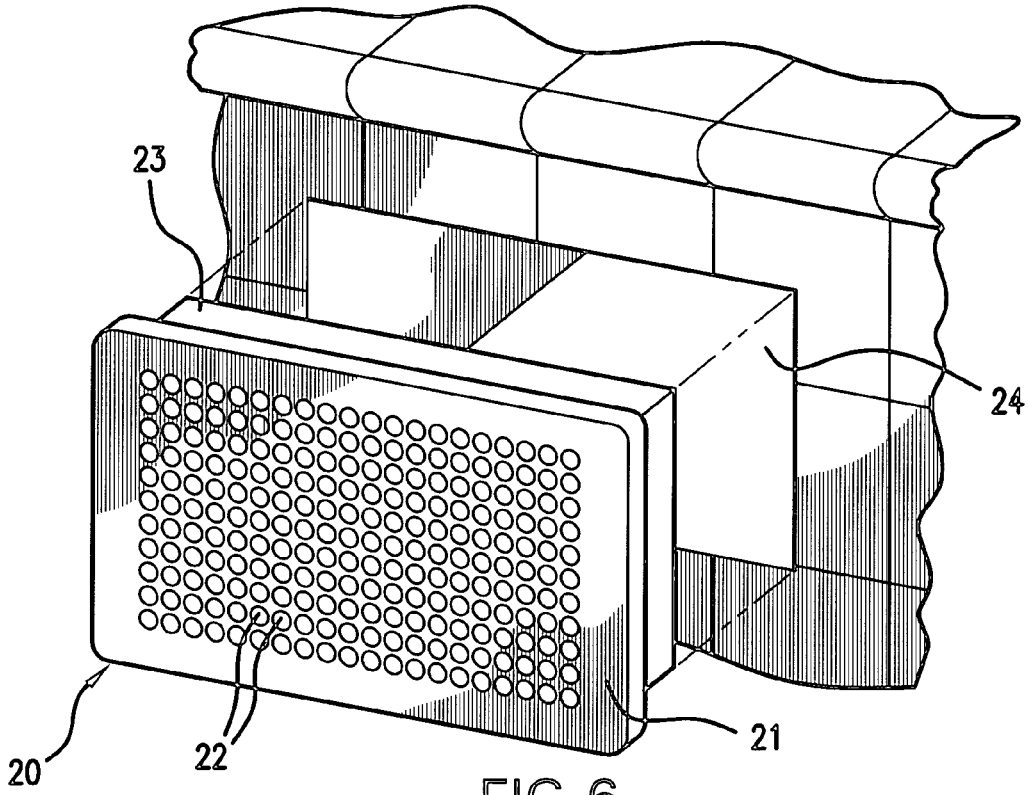
FIG. 6 provides a fragmentary perspective view of an alternative embodiment of the invention, wherein the skimmer guard includes a member which engages the skimmer opening.
Figure 7:
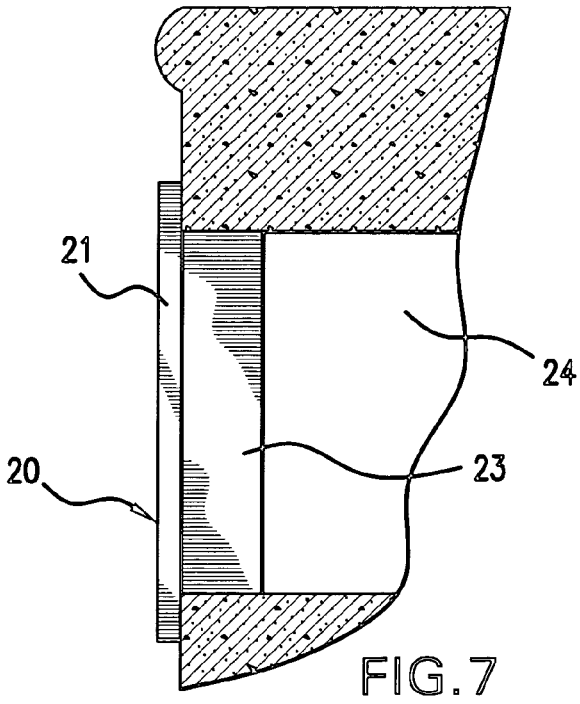
FIG. 7 provides a fragmentary cross-sectional view of the embodiment of FIG. 6, showing the skimmer guard fully inserted into the skimmer opening.

FIGS. 6 and 7 illustrate an alternative embodiment of the present invention. In this embodiment, skimmer guard 20 includes face plate 21 having a plurality of holes 22, and plug portion 23. The plug portion is insertable into skimmer opening 24 by friction, as shown in the figures. FIG. 6 shows the skimmer guard when it is not inserted into the opening. FIG. 7 shows the skimmer guard fully inserted, with the plug portion 23 extending into the opening 24.

The plug portion 23 can be integrally formed with the face plate 21, or it can be separately formed and suitably joined.

In the embodiment of FIGS. 6 and 7, as in the previous embodiment, the skimmer guard is attached to the skimmer opening without the use of screws, nails, or other attachment devices, and without the use of tools. Instead, the attachment is only by friction.

Figure 8:
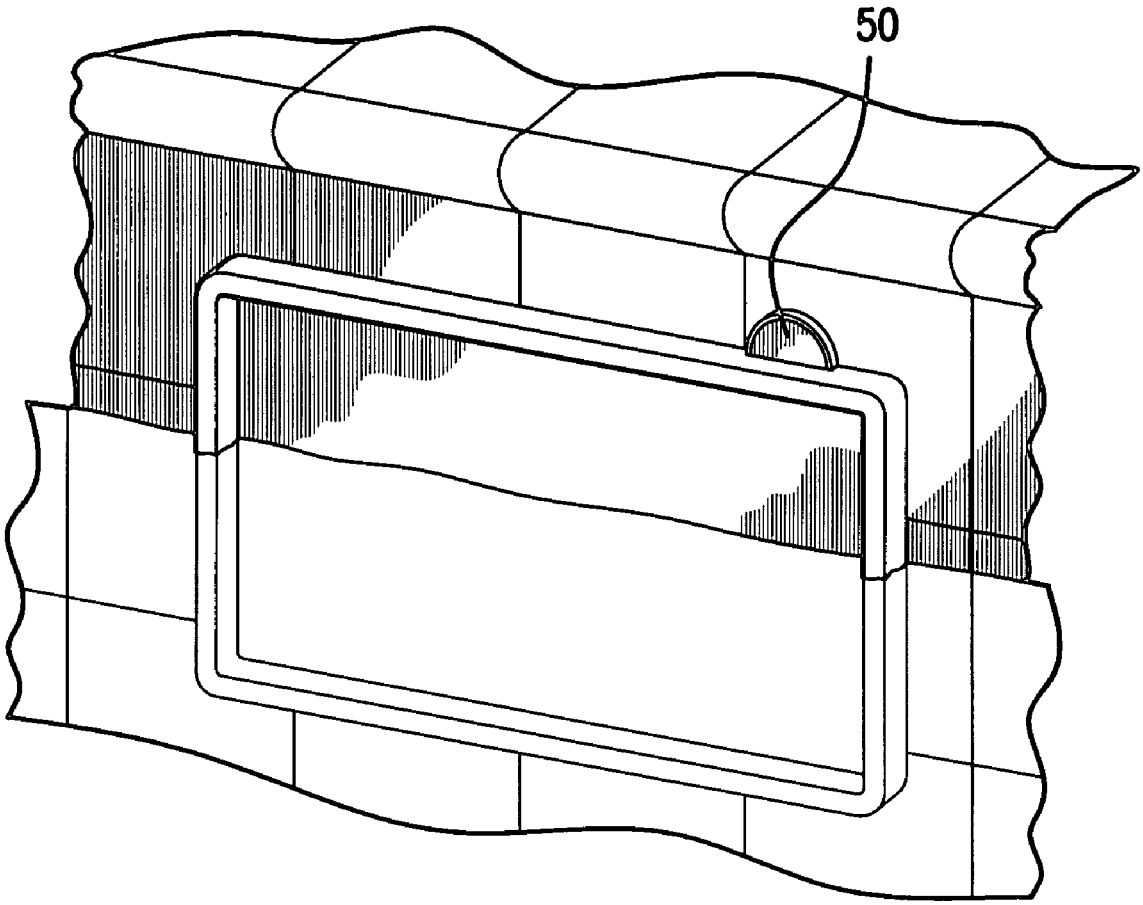
FIG. 8 provides a view similar to that of FIG. 1, in which the skimmer guard has been replaced by a guard that lacks perforations, for use in securing the pool during periods of non-use.

FIG. 8 provides a view similar to that of FIG. 1, except that the skimmer guard has no holes, and the skimmer guard includes tab 50. The tab facilitates the removal of the skimmer guard from the opening. One grasps the tab to lift the skimmer guard away from the opening. The tab therefore makes it easy to remove the skimmer guard without the use of any tool. The tab can be provided with the skimmer guards of any of the other embodiments.

The non-perforated skimmer guard, shown in FIG. 8, is preferably installed during periods when the swimming pool is not in use. It is often considered desirable to keep a pool filled, or partially filled, during the winter season or other periods when the pool is not used. During such periods, the skimmer is also not in use. The non-perforated skimmer guard prevents water from entering the skimmer during such periods.

The present invention therefore includes the method of replacing a non-perforated skimmer guard with a perforated skimmer guard, as would be typically done at the beginning of the swimming season, and replacing a perforated skimmer guard with a non-perforated skimmer guard, as would be done at the end of the swimming season. The above operations could also be performed at other times, if desired. All of the above operations are performed without screws, nails, or other fastening devices, and are preferably performed without any tools. By eliminating the need to use fastening devices or tools, the present invention makes it very easy to change the skimmer guard as desired.

The invention also includes the method of installing the perforated skimmer guard over the pool wall opening. The skimmer guard is simply pushed towards the opening until engagement by friction is complete. In the first embodiment, the lip of the skimmer guard is pushed so as to engage the flange of the frame. In the second embodiment, the plug portion of the skimmer guard is urged into the pool wall opening. In both cases, no separate fasteners, and no special tools, are required.

The skimmer guard of the present invention is preferably made of plastic. However, the invention is not limited to any specific material, and could be practiced with skimmer guards made of wood, metal, or other materials.

The invention can be modified in various ways. The specific shape of the skimmer opening could be changed, and such change would require a corresponding change in the shape of the skimmer guard. For example, the opening could be square, or even circular, in which case the skimmer guard would need to be formed with a similar shape for engagement with the skimmer frame. These and other modifications, which will be apparent to the reader skilled in the art, should be considered within the spirit and scope of the following claims.

What is claimed is:

1. In a pool having an opening, the opening providing fluid communication with a skimmer for treatment of liquid drawn from the pool, the opening being bounded by a frame, the frame including a peripheral flange, the improvement comprising a skimmer guard which includes a body defining a plurality of holes, the body including a peripheral lip which is shaped for frictional engagement with the flange, wherein the skimmer guard is attached to the frame by friction only.

2. The improvement of claim 1, wherein the skimmer guard includes a tab which facilitates removal of the skimmer guard from the frame.

3. The improvement of claim 1, wherein the holes remain unblocked when the skimmer guard is attached to the frame, wherein the holes permit liquid to enter the skimmer while preventing entry of debris from the pool.

4. In a pool having an opening, the opening providing fluid communication with a skimmer for treatment of liquid drawn from the pool, the improvement comprising a skimmer guard which includes a body defining a plurality of holes, the body having means for frictional engagement with the opening, wherein the skimmer guard is affixed to the opening by friction only and without any fastener distinct from the skimmer guard, and wherein the skimmer guard prevents debris from the pool from entering the skimmer, wherein the opening is bounded by a frame, the frame having a peripheral flange, wherein the frictional engagement means comprises a lip formed around a periphery of the skimmer guard, the lip being shaped to engage the flange.

5. The improvement of claim 4, wherein the skimmer guard includes a tab for facilitating removal of the skimmer guard from the frame.

6. In a pool having an opening, the opening providing fluid communication with a skimmer for treatment of liquid drawn from the pool, the improvement comprising a skimmer guard which includes a body defining a plurality of holes, the body having means for frictional engagement with the opening, wherein the skimmer guard is affixed to the opening by friction only and without any fastener distinct from the skimmer guard, and wherein the skimmer guard prevents debris from the pool from entering the skimmer, wherein the means for frictional engagement comprises a plug, the plug being shaped to fit within the opening.

7. The improvement of claim 6, wherein the skimmer guard includes a tab for facilitating removal of the skimmer guard from the opening.

8. A method of protecting a skimmer of a pool from intrusion of debris, the pool including a wall having an opening for allowing liquid from the pool to enter the skimmer, the method comprising frictionally engaging a skimmer guard, the skimmer guard including a body having a plurality of holes, with the opening, wherein the skimmer guard at least partially covers the opening, the skimmer guard being engaged without the use of any separate fastening device, wherein the opening is bounded by a frame, the frame having a flange, the skimmer guard having a lip which is shaped to engage the flange, and wherein the step of frictionally engaging the skimmer guard comprises engaging the lip of the skimmer guard with the flange of the frame.

9. The method of claim 8, further comprising removing the skimmer guard and replacing the skimmer guard with an alternate skimmer guard which is constructed without holes.

10. A method of protecting a skimmer of a pool from intrusion of debris, the pool including a wall having an opening for allowing liquid from the pool to enter the skimmer, the method comprising frictionally engaging a skimmer guard, the skimmer guard including a body having a plurality of holes, with the opening, wherein the skimmer guard at least partially covers the opening, the skimmer guard being engaged without the use of any separate fastening device, wherein the skimmer guard includes a plug which is sized to fit within the opening, and wherein the step of frictionally engaging the skimmer guard comprises engaging the plug with the opening.

11. The method of claim 10, further comprising removing the skimmer guard and replacing the skimmer guard with an alternate skimmer guard which is constructed without holes.

12. A method of protecting a skimmer of a pool from intrusion of debris, the pool including a wall having an opening for allowing liquid from the pool to enter the skimmer, the method comprising frictionally engaging a skimmer guard, the skimmer guard including a body having a plurality of holes, with the opening, wherein the skimmer guard at least partially covers the opening, the skimmer guard being engaged without the use of any separate fastening device, further comprising removing the skimmer guard and replacing the skimmer guard with an alternate skimmer guard which is constructed without holes.

13. The method of claim 12, wherein the skimmer guard includes a tab, and wherein the step of removing the skimmer guard includes pulling on the tab so as to remove the skimmer guard from the opening.

* * * * *